United States Patent [19]

Habisohn

[11] 4,149,337

[45] Apr. 17, 1979

[54] BUBBLE FORMING DEVICE AND A METHOD FOR FORMING THIN FILM SHAPES

[76] Inventor: Victor J. Habisohn, 252 Englewood Rd., Hoffmann Estates, Ill. 60195

[21] Appl. No.: 739,692

[22] Filed: Nov. 8, 1976

[51] Int. Cl.[2] ..... A63H 33/28

[52] U.S. Cl. ..... 46/6; 131/198 A; 239/33

[58] Field of Search ..... 46/6, 7, 8; 131/198 A, 131/218; 239/33

[56] References Cited

U.S. PATENT DOCUMENTS

| | | | |
|---|---|---|---|
| 430,999 | 6/1890 | Latschar | 46/6 |
| 673,488 | 5/1901 | Waterman et al. | 46/6 |
| 2,305,382 | 12/1942 | Hagopian | 46/6 |
| 3,260,462 | 7/1966 | Samaczny | 46/6 X |
| 3,749,312 | 7/1973 | Panzer | 239/33 |

OTHER PUBLICATIONS

*Games of the World,* Ed. by F. V. Grunfeld; Pub. by Holt, Rinehart & Winston, N.Y.C., N.Y., 1975, pp. 276–277.

*Primary Examiner*—F. Barry Shay
*Attorney, Agent, or Firm*—Jerome Goldberg

[57] ABSTRACT

A bubble forming device for forming bubbles and thin film planes spanning the sides of a frame with bubble forming solution. The device includes an air inlet for forcing air into the device, for ejecting air into the thin films or extracting air out from the thin films. The bubble shape is dependent upon the shape of the frame (which may be formed from rods, wire etc.), between which the thin films span. The device is particularly suitable for forming minimal surface planes of thin films inside of very complex frames, by forming a bubble inside of the complex frame previously coated with the film forming solution; causing the bubble to expand and contact each of the sides of the coated frame; and then removing air from the bubble to cause the thin films to form a link with the deflating bubble; and finally when the bubble is substantially deflated it assumes a shape corresponding to the configuration of the frame; and if the bubble is completely deflated, minimal surface thin films link the sides of the frame.

3 Claims, 9 Drawing Figures

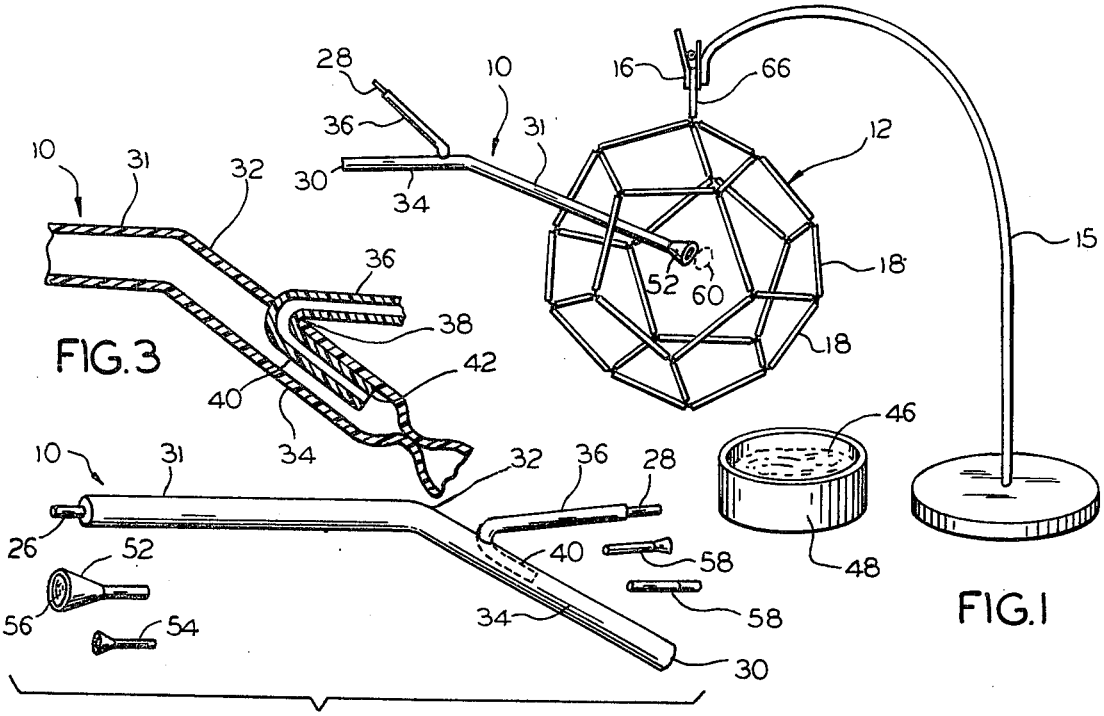
10
31
32
36
38
40
42
34
FIG.3
28
30
16
66
12
18
52
60
15
46
48
26
56
54
58
FIG.1
FIG.2
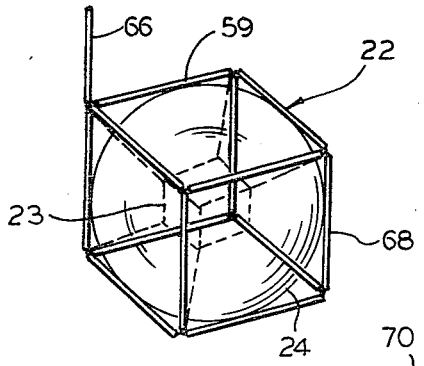
66
59
22
23
68
24
FIG.7
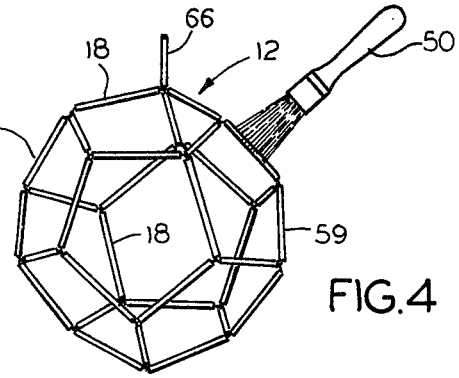
66
18
12
50
59
FIG.4
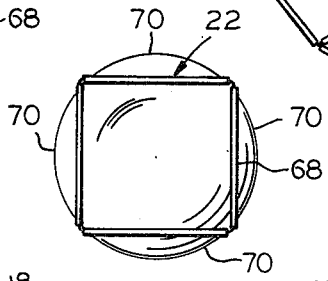
70
22
68
FIG.8
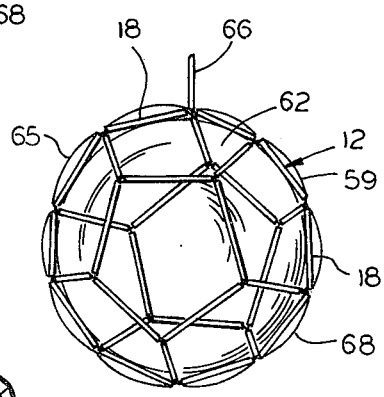
18
66
62
65
12
59
68
FIG.5
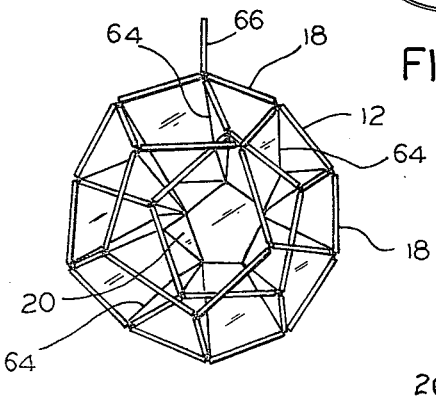
64
66
18
12
20
FIG.6
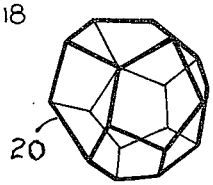
20
FIG.9

BUBBLE FORMING DEVICE AND A METHOD FOR FORMING THIN FILM SHAPES

BACKGROUND OF THE INVENTION

The invention relates generally to a bubble forming device for forming thin film shapes utilizing bubble forming solution, and more specifically relates to a device specifically suitable for forming a continuous minimal surface enveloping or spanning each side of a wire or rod constructed frame. Still more specifically, the invention relates to a method for forming bubbles and thin film shapes with bubble forming solution.

Dipping wire geometric frames into a film forming or soapy solution, for forming substantially flat surfaces stretched across or between wires of the frame upon removal from the solution, was known prior to the invention herein. Also, some extensive scientific research has been previously undertaken with regard to the formation of thin films from a soapy solution, due to the interesting geometric and physics principles involved. Bubbles have also been embedded in the thin films spanning the wire frame, and the shape of such bubbles were dependent upon the frame configuration. Thus, if the frame was a cube, a cube shaped bubble could be formed in the thin films spanning the frame.

Generally, the technique used for forming a bubble inside the films stretched in the frame of a geometric shape was to first dip the frame in a film forming solution; the films should be stretched across the frame upon removal from the solution; and then blowing a bubble of the film in the inside center of the frame, to form a bubble corresponding substantially to the shape of the frame.

The subject invention provides a bubble forming device for accurately controlling the size and shape of the bubble formed inside of the thin film surfaces spanning the frame, and also affords means for easily and successively repeating the formation of the same bubble shape and size inside of the thin films. Previously, it was extremely difficult to control the size of the bubble inside the thin films and to reproduce the same size bubble in the films.

The aforedescribed prior method is suitable for forming thin film shapes and embedding bubbles inside of a simple frame configuration, such as a cube, pyramid or trapezoid. However, for complex frame configurations, thin film shapes were extremely difficult to form due to the films not stretching across all or a sufficient number of sides of the complex frame. Thus, when a complex frame such as a dodecahedron, is lifted out of a soapy solution, thin films are not stretched across the entire frame—one or more of the sides is open. This prevents the formation of the minimal surface planes of thin films inside the frame, and thereby precludes the creation of the esthetic geometric designs corresponding to the complex frame. The subject invention, on the other hand, provides a method and technique for easily and conveniently forming thin film shapes even within the most complex frame structures.

Moreover, the prior afore-described method was often not suitable for forming bubbles or thin film shapes from large sized frame configurations, since a sufficient volume of the film forming solution was always required inorder to completely immerse the large frame prior to forming the films or bubbles. The method of the subject invention does not require dipping of the frame into the film forming solution, and, therefore, enlarged bubbles and thin film shapes may be formed with even small quantities of film forming solution.

The formation of a variety of different thin film shapes and bubbles that can be formed with various frame configurations, can provide hours of fun and enjoyment for children and even adults. The bubbles can be blown up by forcing air in the bubble, and can be deflated by extracting air from the bubble. Prior to the subject invention, air was generally blown into the bubble via a straw, and to deflate the bubble the air was sucked out from the bubble also via the straw. Often, the sucking in of the air also sucked up the film forming or soapy solution, which did not have the most pleasant taste. The subject invention is particularly directed to provide a straw, which does not suck the soapy solution into the mouth, but nevertheless enables the bubble to be inflated and deflated.

It is, therefore, a primary object of the subject invention to provide a device for forming bubbles and thin film shapes. A related primary object is to provide a method for forming thin film shapes.

Another object is to provide a bubble forming device for forming 3-dimensional bubbles inside of rodular or wire constructed frames.

Another object is to provide a bubble forming device that easily inflates and deflates bubbles having various shapes.

Another object is to provide thin film shapes inside of wire or rod frames, without the necessity of dipping the frame entirely inside film forming solution.

Another object is to form thin films and bubbles inside of complex frame configurations.

A feature of the subject invention is to provide a bubble forming device including an air inlet for forcing air into the device, to either eject air into bubbles of film forming solution, or to force air into the device for extracting air from bubbles, to vary or control the size of the bubbles.

BRIEF DESCRIPTION OF THE DRAWING

Referring now to the drawing, in which the same characters of reference are employed to indicate corresponding similar parts throughout the several figures of the drawing:

FIG. 1 is a perspective view of the bubble forming device inside a dodecahedron shaped rod frame, to utilize film forming solution and form thin films and bubbles, and embodying the principles of the invention;

FIG. 2 is a perspective view of the bubble forming device including removable tips and removable caps;

FIG. 3 is an enlarged sectional view of the joint of the bubble forming device;

FIG. 4 illustrates the frame being coated with the film forming solution;

FIG. 5 illustrates a bubble formed in the film coated frame and in contact with the sides of the frame;

FIG. 6 illustrates the size of the bubble in FIG. 5 deflated to form a dodecahedron bubble, and thin films link the bubble with the sides of the frame;

FIG. 7 illustrates a bubble inside a cubed shaped rodular frame;

FIG. 8 is a side view of the frame in FIG. 7 after the bubble therein has been expanded to contact each of the rods, and the bubble is further shown bulging out from the side of the frame; and FIG. 9 is a perspective view of a dodecahedron bubble.

DESCRIPTION OF THE PREFERRED EMBODIMENT

Referring now to FIGS. 1, 2, and 3 of the drawing, the reference numeral 10 indicates generally a bubble forming device for forming a thin film bubble(s) inside of a frame 12. A holder 15 having a clip end 16 supports the frame 12 when the bubble(s) and thin films are formed and shaped.

The frame 12 may be constructed from a plurality of rods or wires 18 to form a predetermined configuration. The rods 18 of the frame 12 in FIGS. 1, 4, 5, and 6, for illustrative purposes are constructed into a dodecahedron configuration (a solid having 12 faces). A bubble 20 (FIG. 6) having 12 faces may be formed inside the dodecahedron. If the frame were constructed into an hexagonal or pentagonal shape (not shown) a hexagonal or pentagonal bubble may be formed respectively inside thereof. In the cube frame 22 in FIG. 7, a cube bubble 23 shown in phantom, may be formed inside thereof upon deflating the bubble 24 in contact with all the sides of the frame 22.

The bubble forming device 10 comprises a bubble forming end 26, an air input end 28, and an air release end 30. A main cylindrical tube porion 31 extends from the bubble forming end 26 to a joint 32. An air discharge cylindrical tube portion 34 angles downward from the joint 32 as viewed from FIGS. 2 and 3. Tube portions 31 and 34 may be formed from a single hollow cylindrical member which is angularly bent at the joint 32.

An air inflow tubular member 36 extends from the air input end 28 into the air discharge tube portion 34 via an opening 38 formed therein below the joint 32, and therefore, is also below the level of the main tube portion 31, as viewed in FIGS. 2 and 3. The cross-sectional dimension of the tube part 40 of the tubular member 36 inside the air discharge portion 34 is sufficiently less than the inside cross-sectional dimension of the discharge tube portion 34 to enable adequate air flow to take place toward the bubble forming end 26 and the air discharge end 30.

The air discharge tube portion 34 is flexible and resilient, so that the air discharge end 30 may be closed off merely by compressing the tube portion 34 below the inner end 42 of the tubular member 36, as shown in FIG. 3.

When the discharge end 30 is closed, air flows from the air input end 28 into the air inflow tubular member 36 and out the inner end 42 thereof and into the air discharge tube 34, where it flows upward past the joint 32 and into the main tube portion 31 and finally out the bubble forming end 26. If the discharge end 30 is not closed, air flows from the air input end 28 into the air inflow tubular member 36 and out the inner end 42 thereof and into the air discharge tube 34 where it forces the air to the outside via the air release opening 30. Air from the main tube 31 rushes into the air discharge tube 34 to fill the vacuum (really a lower pressure area), which in turn, causes air to be sucked out from the bubble in contact with the bubble forming end 26 and thereby deflating the bubble.

In operation, the bubble forming device 10 is positioned in contact with a bubble forming film associated with the frame 12. The air release end 30 is closed off by compressing the tube portion 34 below the inner end 42 of the air inflow tubular member 36. Air is blown into the device 10 at the air input end 28. The air flows through the air inflow tubular member 36 and into the air discharge tube portion 34, into the main tube portion 31, and finally the air is forced out of the bubble forming end 26, to inflate the bubble, which may be shaped to a form corresponding to the construction of the frame. To deflate the bubble, it is required to release the closure for the air release end 30, so that air is sucked out from the bubble when air is blown into the air input end 28, and the sucked out air is discharged to the outside via the air release end 30. Hence, air is blown into the air input end 28 to either inflate or deflate the bubble.

It should be pointed out that the part of the bubble forming device 10 positioned in contact with the bubble or the bubble forming film associated with the frame, must be wet with the bubble forming fluid prior to making contact in order to prevent the bubble from breaking. Wetting the contacting part of the device 10 prior to making contact with the bubble film, is particularly important when entering an enclosed bubble to prevent bursting of the bubble.

The bubble or film forming solution 46 may be contained in a container 48, which is dimensioned substantially smaller than the frame 12. As may be seen from FIG. 1, the frame 12 cannot be dipped or fully immersed in the container 48. To apply the film forming solution to the frame 12, a brush 50 (FIG. 4) may be used, or other suitable means may be used for applying the solution 46.

The bubble forming end 26 (FIG. 2) may be replaced with bubble forming tips 52 or 54. The tips 52, 54 may include serrations 56 for retaining the bubble forming solution. The different sized tips enable the control of the initial bubble size. The larger the tip the larger the initial bubble that can be formed.

As may also be seen in FIG. 2, the air input end 28 may also be replaced with air input ends 58. For sanitary reasons, the different users of the device 10 may have his or her own tip, or it may be desirable due to continual lip contact to change the tip or end 28 from time to time.

Turning now to FIGS. 1, 4, 5 and 6, the method for forming thin film shapes will be described. Initially, the frame 12 is completely coated with the film forming solution 46 to provide a film covering 59. The brush 50 may be used to form the film covering 59, as may be seen from FIG. 4. Now, the bubble forming device 10 is used to form and shape the thin film bubble(s) and thin film forms.

Initially, a bubble 60 (FIG. 1) is formed which is small and substantially circular. The bubble 60 is inflated by forcing air therein until it expands to the bubble 62 shown in FIG. 5. The bubble 62 contacts each of the sides of the frame 12 formed by the rods 18. Thus, the bubble 62 is in contact with the film covering 59.

The bubble 62 is now deflated and as the bubble 62 contracts, thin films 64 stretch inward to link the rods 18 forming the sides of the frame 12 (the sides of the dodecahedron) with the contracting bubble 62. Finally, the bubble 62 has been sufficiently deflated to convert into the 12 sided dodecahedron bubble 20, centrally positioned and linked to the frame 12 with the films 64.

Note in FIG. 5 that the bubble 62 includes bulges 65 which extend out from the frame. In this manner, the bubble 62 makes contact with each of the rods 18 of the dodecahedron construction. Hence, when the bubble 62 is deflated thin films 64 link the deflating bubble with each side of the frame 12.

It should also be noted that although the brush 50 is used to coat the frame 12, the entire frame may be dipped into the film forming solution 46 (provided that the container 48 for the solution is of sufficient size to receive the entire frame 12).

Prior to forming the bubble 60 (FIG. 1), the bubble forming tip 26 of the device 10 is dipped into the film forming solution 46; the air discharge end 30 is closed by compressing the tube tube portion 34 below the output end 42 of the air inflow tubular member 36, but at a point not to inhibit air flow out from the tube 36; and as air is blown into the air input end 28 the bubble 60 is formed. Upon continuing to blow air into the air input end 28 of the device 10, the bubble 60 expands to the bubble size 62 (FIG. 5) in contact with all the sides or rods 18 of the frame 12. Prior to forming the dodecahedron bubble 20, the air discharge end 30 is opened by releasing the compressing force previously applied; and when the bubble forming end 26 is still in contact with the bubble 62, air is again blown into the air input end 28 to create a vacuum inside the air discharge tube 34 and thereby cause air to be sucked out from the bubble 62 to deflate the bubble 62, so that the bubble 62, which is circular in shape, is converted into the dodecahedron bubble 20 held and supported in place by the thin films 64.

A handle 66 is attached to the frame 12 and the frame 22, to provide a gripping surface when forming bubbles and thin film shapes. In order to have two hands free to manipulate the bubble forming device 10, the handle 66 may be secured in place by the clip end 16 of the holder 15.

In FIG. 7, the cube frame 22 is constructed with rods 68, and the bubble 24 is shown therein in contact with the sides or rods 68. Since the frame sides or rods 68 are coated with the film 59 of the bubble forming solution 46, the cube bubble 23 (shown in phantom) will be formed inside the cube frame 22 with the thin films 64 linking the rods 68 of the frame 22 with the cube bubble 23, upon sufficiently deflating the bubble 24. Therefore, the bubble forming device 10 is used to form the bubble 24 by inflating an initially formed bubble, such as bubble 60 in FIG. 1, and thereafter deflating the bubble 24 to form the cubed bubble 23.

Bubble 24 is initially substantially circular until it contacts the rods 68 of the frame 22, and the bubble 24 then distorts as it is continued to be inflated. Bulges 70 form in the bubble 24 and extend out from the frame 22. Bulges 70 deflate as the bubble 24 is deflated.

The description of the preferred embodiment of this invention is intended merely as illustrative of this invention, the scope and limits of which are set forth in the following claims.

I claim:

1. A bubble forming device for forming bubbles and thin film shapes from bubble forming solution, comprising:

a body having a passage therein;

a bubble forming end through which said passage opens whereby air is injected from or sucked into the device;

an air input end through which said passage opens for forcing air into the device, to either cause air to be ejected from or sucked into the device via said bubble forming end, to cause respectively one of said bubbles to be inflated or deflated;

an air release end through which said passage opens, said air release end having a closed-condition and an open-condition, all of said ends being arranged with respect to each other along said passage in a manner whereby air blown into said input end will be ejected from said bubble forming end when the air release end is in the closed-condition and said air will be sucked into said bubble forming end when the air release end is in the open-condition, said body including:

a tube having said bubble forming end on one end and said air release end at the opposite end thereof;

a tubular member having said air input end on the outer end thereof; and an opening formed in the tube for receiving an extending part of said tubular member, said part of the tubular member extending along the interior wall of said tube and having a cross-sectional area sufficiently less than the inside of the tube adjacent thereto to permit air flow between said bubble forming end and said air release end, the other end of said tubular member being positioned between said ends of said tube.

2. A method for forming bubbles using a device having an open passage therethrough for forming bubbles, including the steps of:

coating an outer end of the passage with the film forming solution;

forcing air into another end of the passage while controlling the device to cause air to flow out from said coated end to form and expand the size of a bubble at said outer end; and forcing air into said other end of the passage while controlling the device to deflate the size of the bubble.

3. The method of claim 2 including:

closing a third end of said passage when forcing air into said other end of the passage to cause said air to flow out from said coated end; and opening said third end of the passage when forcing air into said other end of the passage for deflating said size of the bubble.

* * * * *